US006688487B2

(12) United States Patent
Oakes et al.

(10) Patent No.: US 6,688,487 B2
(45) Date of Patent: Feb. 10, 2004

(54) LOCKING CUP AND LID WITH NEGATIVE DRAFT SEALING SURFACES

(75) Inventors: Shawn A. Oakes, Ripon, WI (US); Freida St. Germain, Mableton, GA (US)

(73) Assignee: The Coca-Cola Company, Atlanta, GA (US)

( * ) Notice: Subject to any disclaimer, the term of this patent is extended or adjusted under 35 U.S.C. 154(b) by 126 days.

(21) Appl. No.: 09/835,100

(22) Filed: Apr. 13, 2001

(65) Prior Publication Data

US 2003/0085228 A1 May 8, 2003

(51) Int. Cl.[7] ..... B65D 41/16

(52) U.S. Cl. ..... 220/788; 215/318; 215/321; 220/302; 220/298; 220/788; 220/669; 220/659; 220/792; 220/703

(58) Field of Search ..... 215/318, 317, 215/321, 357, 329; 229/404; 220/293, 298, 302, 780, 784, 787, 788, 789, 711, 713, 705, 783, 797, 669, 659, 790–792, 281, 297, 4.21; D7/900, 392.1, 396.2, 612–615, 629; D9/413, 435, 452, 453, 428, 429

(56) References Cited

U.S. PATENT DOCUMENTS

| | | | | | |
|---|---|---|---|---|---|
| 253,075 | A | | 1/1882 | Lyon | |
| 2,679,878 | A | * | 6/1954 | Stine | 220/212.5 |
| 2,706,065 | A | * | 4/1955 | Stone | 220/789 |
| 3,142,409 | A | * | 7/1964 | Ross | 220/281 |
| 3,349,950 | A | * | 10/1967 | Wanderer | 220/287 |
| 3,460,711 | A | | 8/1969 | Al-Roy | |
| 3,520,441 | A | * | 7/1970 | Fitzgerald | 206/519 |
| 4,332,332 | A | * | 6/1982 | Ingemann | 220/276 |
| 4,679,699 | A | | 7/1987 | Malsbury et al. | |
| 4,726,489 | A | * | 2/1988 | Padovani | 206/519 |
| 5,339,977 | A | * | 8/1994 | Schormair et al. | 220/789 |
| 5,507,406 | A | * | 4/1996 | Urciuoli et al. | 220/269 |
| D372,396 | S | * | 8/1996 | Seager | D7/391 |
| 5,605,244 | A | * | 2/1997 | Bradshaw | 220/298 |
| 5,758,791 | A | * | 6/1998 | Mangla | 220/4.21 |
| 5,792,496 | A | * | 8/1998 | Fekete et al. | 220/4.21 |
| D447,053 | S | * | 8/2001 | Chagnon et al. | D9/428 |
| D453,107 | S | * | 1/2002 | Wyslotsky et al. | D9/428 |

FOREIGN PATENT DOCUMENTS

| | | |
|---|---|---|
| DE | 81 25 268 | 3/1982 |
| GB | 2 297 076 | 7/1996 |

* cited by examiner

*Primary Examiner*—Robin A. Hylton
(74) *Attorney, Agent, or Firm*—Andrus, Sceales, Starke & Sawall

(57) ABSTRACT

A multi-sealing, multi-locking and reopenable cup and lid assembly includes a cup that has an open circular mouth defining an interior locking groove and an undercut frustoconical sealing surface, and a resilient circular lid having a peripheral lip and a frustoconical sealing surface complementary to cup sealing surface. Insertion of the lid into the cup creates a snap-in lock of the lip in the locking groove and a liquid-tight seal between the sealing surfaces. Interrupted portions in the interface between the lid lip and the locking groove in the cup may be aligned by manual rotation of the locked lid for unlocking and easy removal thereof.

16 Claims, 7 Drawing Sheets

FIG. 8
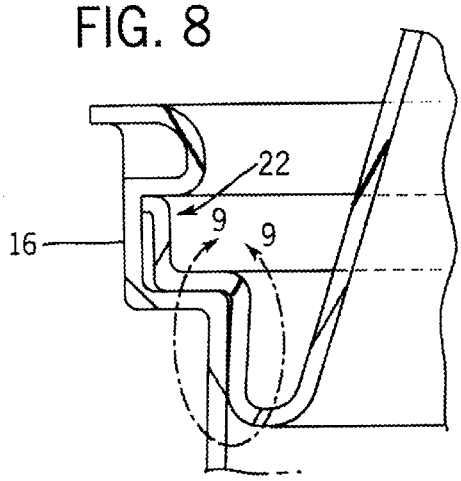
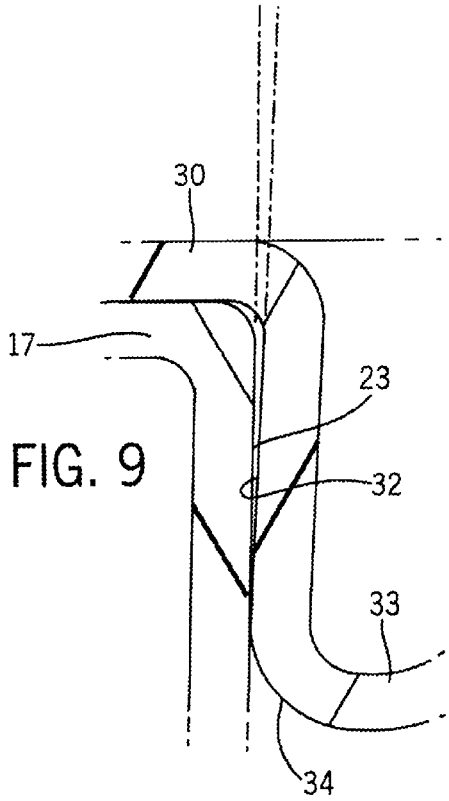
FIG. 9
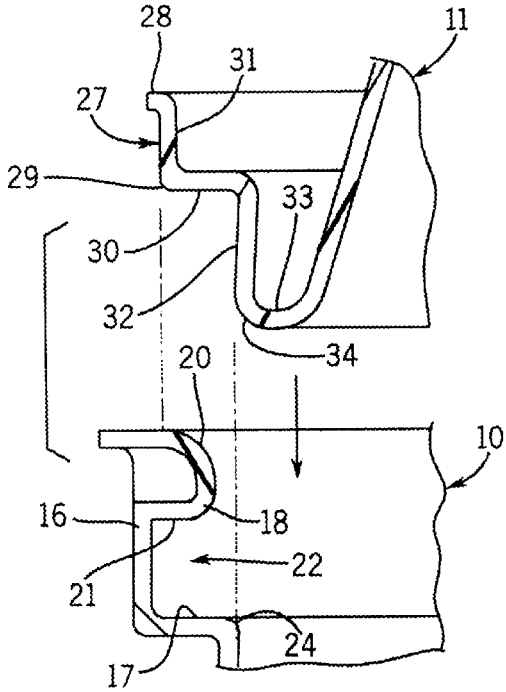
FIG. 10
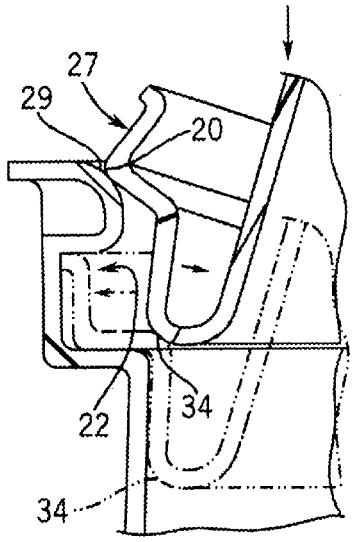
FIG. 11

LOCKING CUP AND LID WITH NEGATIVE DRAFT SEALING SURFACES

BACKGROUND OF THE INVENTION

The present invention pertains to closed plastic containers and, more particularly, to containers having a separate cup and lid which, when attached to close the container, provide a continuous seal and locked engagement.

Plastic containers are widely used for innumerable packaging functions. Flexible thin wall plastic containers are particularly attractive in food service and similar applications because of their light weight and low cost. Such containers are commonly made using thermoforming or vacuum forming techniques. There are many plastic resins which are suitable for these containers, including PET and polystyrenes.

When used as beverage containers or containers for other liquid food products, the cups are typically closed with a generally flat lid that snaps over the lip defining the mouth of the cup. The lid may be completely closed to prevent or inhibit leakage or may have openings or openable areas for access, as for a drinking straw. Snap-on lids or covers, though providing some protection against leakage and spillage, are not secure. These lids are quite easily inadvertently dislodged by the user and cannot provide a secure closure if the container is tipped over, much less so if it is dropped.

It would be desirable to have a container, such as a beverage cup and lid, in which the lid could be readily attached in a manner that provides a liquid-tight seal and also lock the lid against inadvertent opening. It would be desirable to have such a sealing and locking cup and lid in which the lid could be readily removed by the user if desired.

SUMMARY OF THE INVENTION

In accordance with the present invention, a sealed, locked and reopenable cup and lid assembly utilizes a cup that has an open circular mouth defined by an upper edge, an inwardly opening locking groove below the upper edge, and a frustoconical inner wall portion that extends downwardly and diverges outwardly from the locking groove; a resilient circular lid that is sized to be inserted into the open mouth of the cup and has an outer peripheral lip that is received with a snap fit in the locking groove in the cup, and a frustoconical sealing wall that extends downwardly and diverges outwardly from the peripheral lip and sealingly engages the frustoconical inner wall portion on the cup; and, interrupted portions in the locking groove and in the peripheral lip that are circumferentially spaced and rotationally alignable to permit removal of the lid.

Preferably, the locking groove is defined by a plurality of protrusions that extend radially inwardly from the upper edge of the cup and an annular horizontal cup wall portion positioned below and spaced from the protrusions. The outer peripheral lip of the lid preferably comprises generally horizontal upper and lower lip surfaces that are interconnected by a generally vertical intermediate lip surface. The protrusions have generally coplanar lower surfaces and the peripheral lip is captured in the locking groove by engagement of the upper and lower surfaces of the lip with the lower surfaces of the protrusions and the horizontal wall portion, respectively. The interrupted portions in the peripheral lip of the lid are in the form of recesses that correspond to the protrusions on the upper edge of the cup and permit reopening movement of the lid past the protrusions.

The frustoconical inner wall portion of the cup extends downwardly from the radially inner edge of the horizontal wall portion and forms with it an edge bead having a first diameter. The frustoconical sealing wall on the lid extends downwardly from the radially inner edge of the lower lip surface and forms with it a second edge bead having a second diameter greater than the first diameter. The second edge bead is adapted to override the first edge bead by lateral deflection in response to lid insertion and to resiliently return to provide the sealing engagement between the frustoconical sealing wall of the lid and the frustoconical wall portion of the cup. Preferably, the angle of divergence of the frustoconical wall portion is less than the angle of divergence of the frustoconical sealing wall.

BRIEF DESCRIPTION OF THE DRAWINGS

FIG. 8 is an enlarged sectional detail of a portion of FIG. 7.

FIG. 9 is a further enlarged detail of a portion of FIG. 8.

FIG. 10 is an enlarged sectional detail taken on line 10—10 of FIG. 2

FIG. 11 is a sectional detail showing the resilient movement of the lid as it snaps into locking engagement with the cup.

DETAILED DESCRIPTION OF THE PREFERRED EMBODIMENTS

Figure 1:
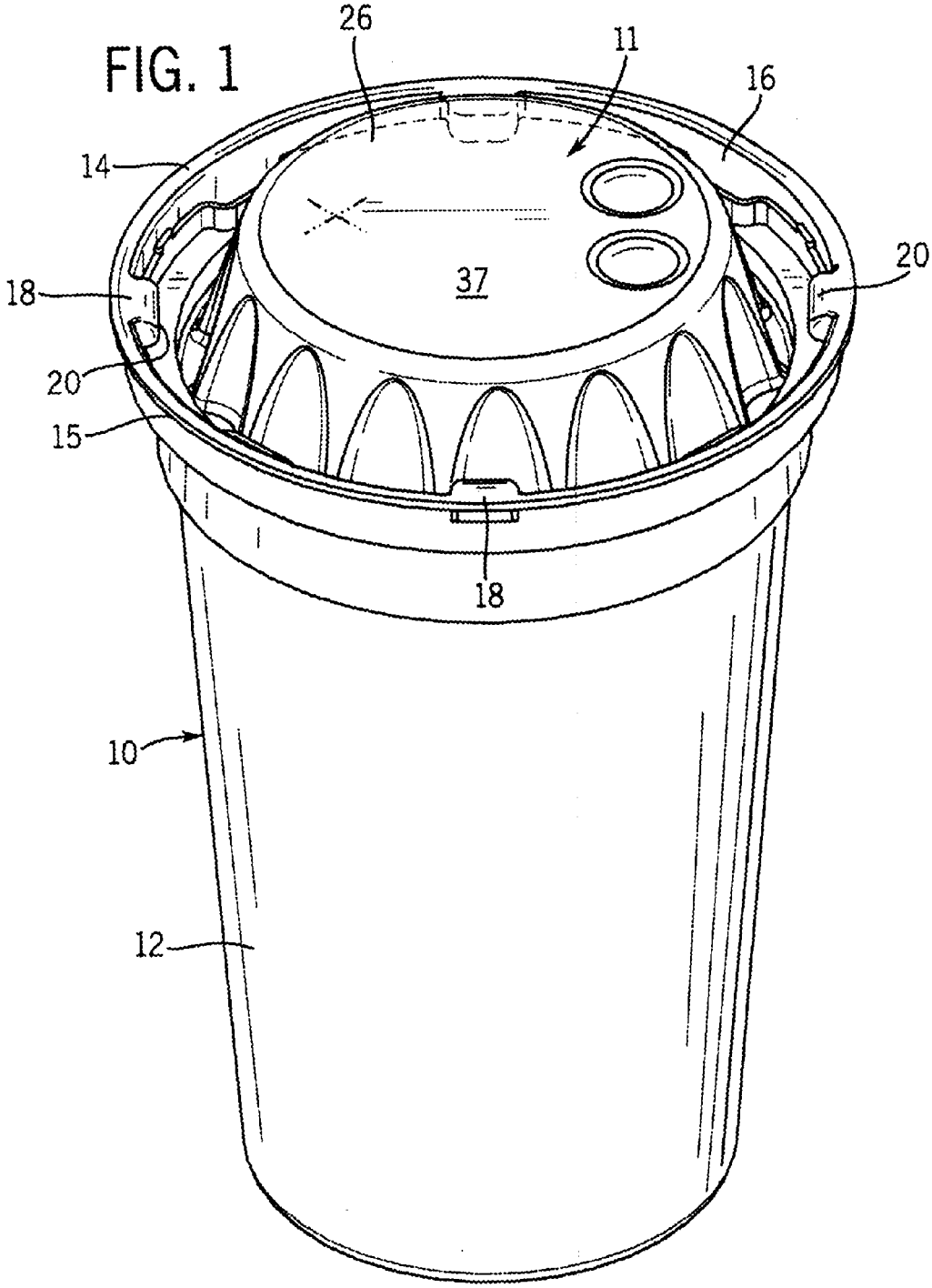
FIG. 1 is a perspective view of a closed and locked cup and lid assembly of the present invention.

A perspective view of an assembled cup 10 and lid 11 of a presently preferred embodiment of the invention is shown in FIG. 1. The cup and lid are preferably thermoformed of a suitable plastic material, but other molding methods may also be used. Further, any of the well known and commonly used thermoforming plastic resins may be utilized, including PET and polystyrenes. It is also contemplated that foam plastic may be utilized. Similarly, the gauge or material thicknesses may vary widely, dependent on factors well known and typically applied in the industry.

Figure 2:
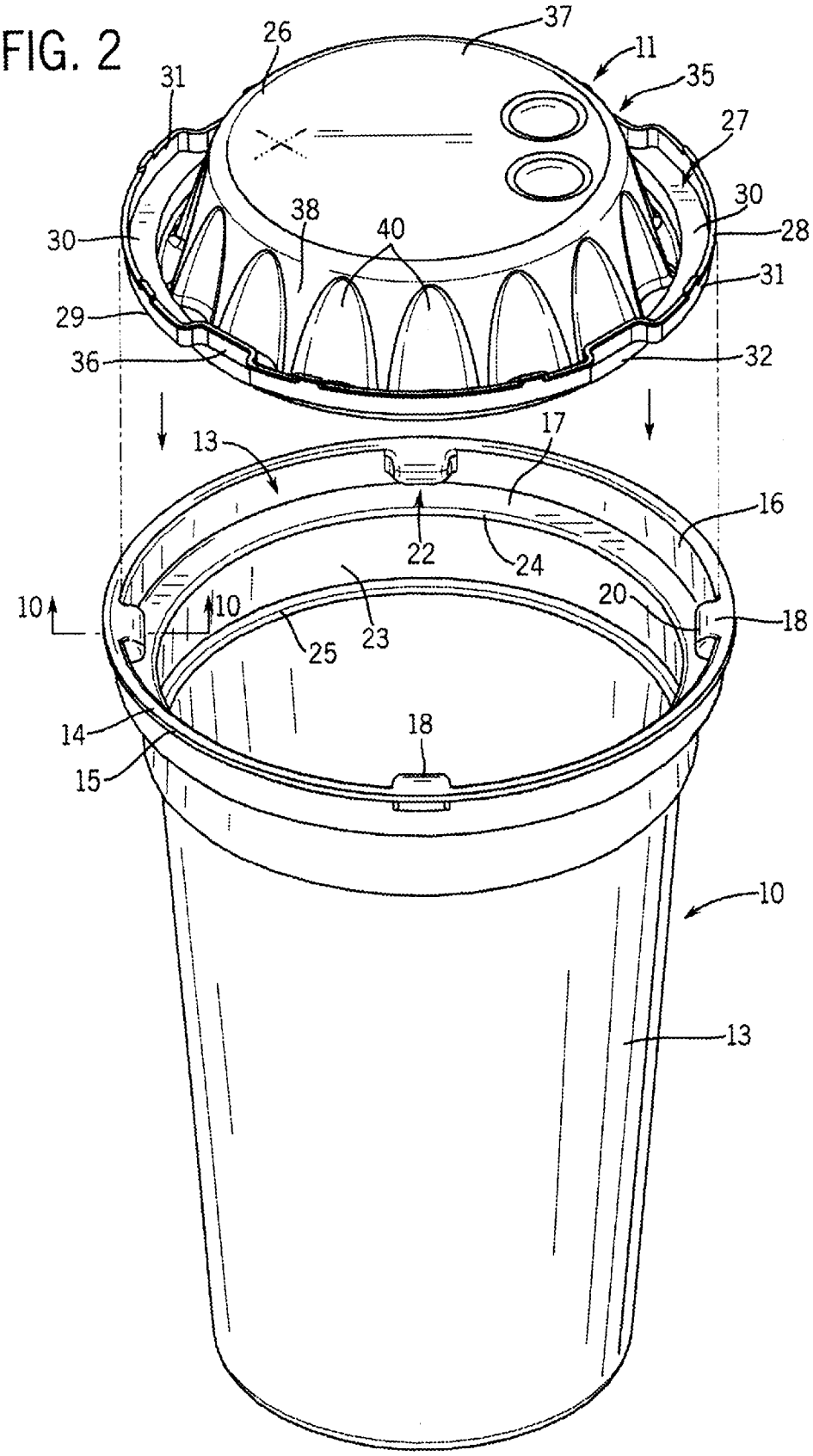
FIG. 2 is an exploded perspective view of the assembly of FIG. 1 showing the lid ready for downward snap-in installation in the mouth of the cup.
Figure 3:
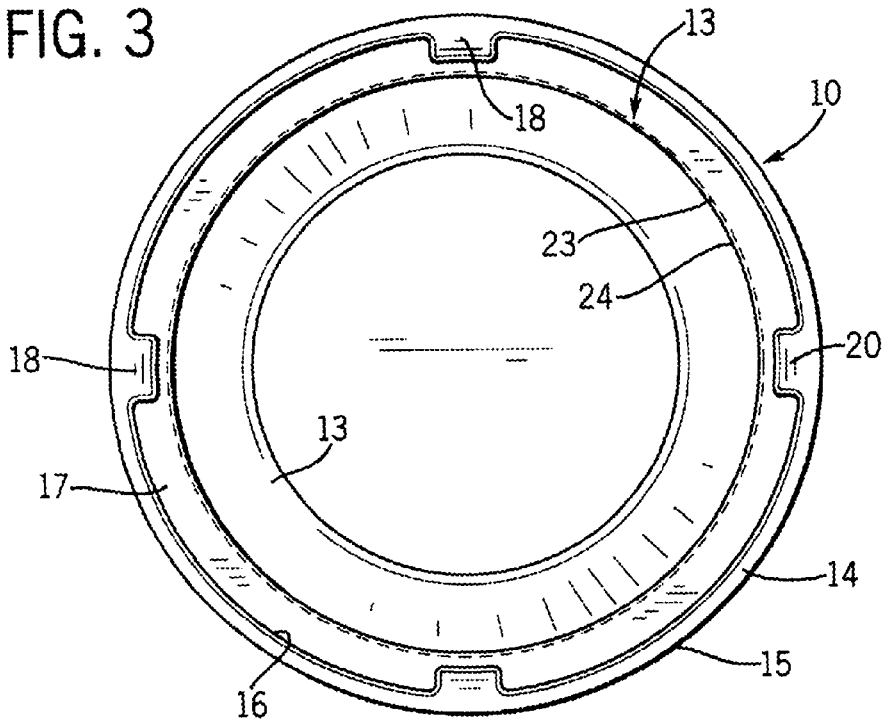
FIG. 3 is a top plan view of the cup shown in FIG. 2.
Figure 4:
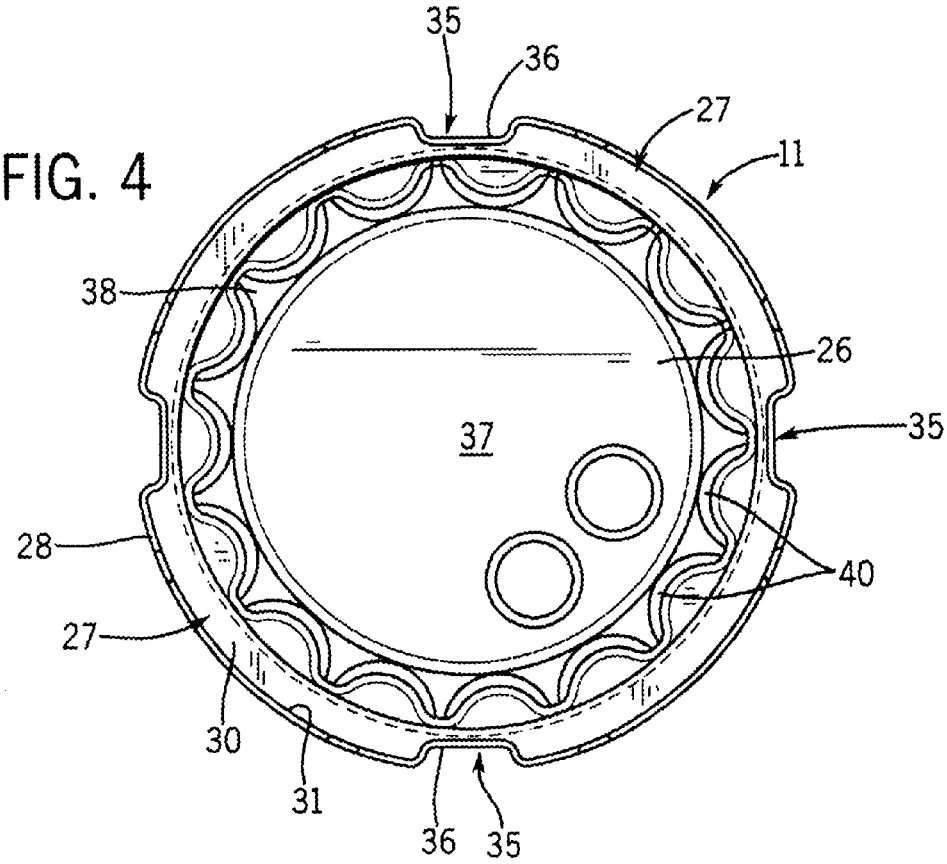
FIG. 4 is a top plan view of the lid shown in FIG. 2.

Referring also to FIGS. 2 and 3, the cup 10 includes a lower body 12 which, though shown in a smooth frustoconical shape, could as well be grooved, ribbed, or in any of the myriad shapes and designs producible in conventional thermoforming techniques. The cup has an open circular mouth defined by a rounded upper rim 14 terminating outwardly in a trimmed edge 15. The rim 14 defines the upper edge of a cylindrical and generally vertical inner first wall portion 16 which is joined at its lower edge by an annular generally horizontal second wall portion 17 that extends radially inwardly from the vertical first wall portion 16. The vertical first wall portion 16 is also provided with a series of circumferentially spaced locking protrusions 18, each of which slopes inwardly and downwardly from the rim 14 to provide lead-ins 20, the function of which will be described below. The locking protrusions 18 have generally flat lower surfaces 21 that are spaced vertically above horizontal second wall portion 17 and lie generally coplanar. The lower surfaces 21 of the protrusions 18, the vertical first wall portion 16 and the horizontal second wall portion 17 together define a locking groove 22 for the lid 11.

Joined to the inner edge of the second wall portion 17 and extending downwardly therefrom is a generally vertical inner third wall portion 23. The circular edge defining the junction between the second and third wall portions 17 and 23 defines an edge bead 24. The third wall portion 23 has a frustoconical shape that is outwardly divergent in the downward direction. The draft angle or angle of divergence of the wall portion 23 may, for example, be about 1.5°, but may vary considerably depending on the size and shape of the cup and the interfitting lid 11. A horizontal fourth wall portion 25 joins the lower edge of the third wall portion 23 with the cup body 12.

Referring also to FIGS. 4–7 and 10, the lid 11 has a central body 26 and a compound peripheral lip 27 that engages the mouth of the cup 10 to lock the lid in place and provide the liquid-tight seal. The lip 27 includes an outermost horizontal upper lip surface 27 and a horizontal lower lip surface 30 interconnected by a generally vertical intermediate surface 31. The inner edge of the horizontal lower lip surface 30 is joined to a frustoconical generally vertical sealing wall 32 that extends downwardly and diverges outwardly. The draft angle or angle of divergence of the sealing wall 32 may be, for example, 3° which is somewhat larger than the draft angle of the frustoconical third wall portion 23 of the cup. The lower edge of the sealing wall 32 is connected to the lid body 26 by an annular connecting surface 33. The circular junction between the frustoconical sealing wall 32 and the annular connecting surface 33 defines an outer edge bead 34.

When it is desired to secure the lid 11 to the cup 10, the lid is placed in the mouth 13 (see FIG. 10) and pressed vertically downward. The compound peripheral lip arrangement 27 has a diameter greater than the minimum diameter defined by the locking protrusions 18 that extend inwardly from the upper first wall portion 16 of the cup. Thus, downwardly movement of the lid will cause resilient inward deflection of the lip arrangement 27 as the rounded edge 29 joining surfaces 30 and 31 passes over the lead-in surfaces 20 of the locking protrusions, as shown in FIG. 11. Primary resilient deflection takes place in the lid because the cup is typically made of a heavier gauge material and is more rigid. However, some inherent outward deflection of mouth 13 of the cup may also occur. As the outermost edge of the upper lip surface 28 reaches the lower surfaces 21 of the locking protrusions, the entire lip 27 snaps into the locking groove 22 which is dimensioned so that upper lip surface 28 bears on the lower surfaces 21 of the protrusions and the lower lip surface 30 bears on the horizontal second wall portion 17 of the cup. Simultaneously with the downward movement of the lid over the lead-in surfaces of the locking protrusions 18, the outer edge bead 34 at the bottom of the lid 11 engages the inner edge bead 24 at the top of the frustoconical third wall portion 23 of the cup. The lid outer edge bead 34 has a slightly larger diameter than the cup inner edge bead 24. Resilient deflection of the lip 27 of the lid causes the outer edge bead 34 to override the inner edge bead and to move with a secondary snap-in movement under the inner edge bead, bringing the sealing wall 32 of the lid into sealing engagement with the wall portion 23.

The interconnection of the lid 11 to the cup 10, described above, results in a positive primary locking of the lip arrangement 27 of the lid in the locking groove 22 of the cup, a primary liquid-tight seal between the frustoconical wall portion 23 of the cup and the frustoconical sealing wall 32 of the lid, a secondary liquid seal between the lower lip surface 30 of the lid and the horizontal wall portion 17 of the cup, and a secondary lock formed when the inner edge bead 24 of the cup overrides the outer edge bead 34 of the lid as the frustoconical sealing surfaces 23 and 32 come into engagement.

Figure 5:
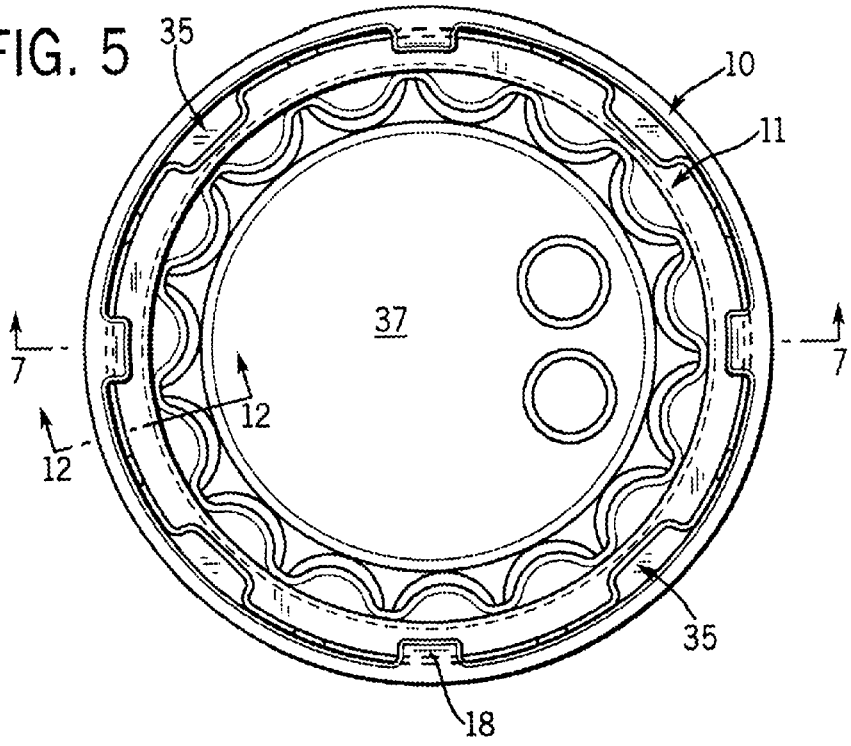
FIG. 5 is a top plan view of the assembled cup and lid shown in FIG. 1.

The positive primary lock of the lid lip 27 in the cup locking groove 22, as may best be seen in FIGS. 5 and 8, virtually precludes removal of the lid unless it is permanently deformed or torn. The lock and corresponding liquid-tight seal are capable of withstanding a significant drop impact with a filled cup without dislodging the lid or allowing the contents to leak.

Figure 6:
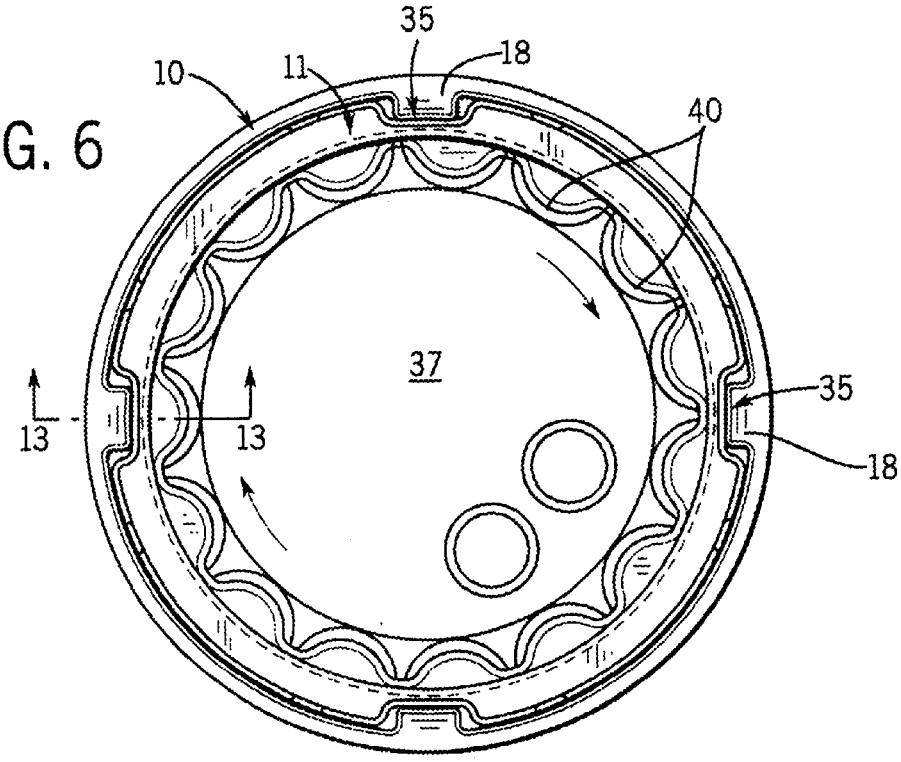
FIG. 6 is a top plan view of the cup and lid assembly of FIG. 5, further showing rotation of the lid to an unlocked position.
Figure 7:
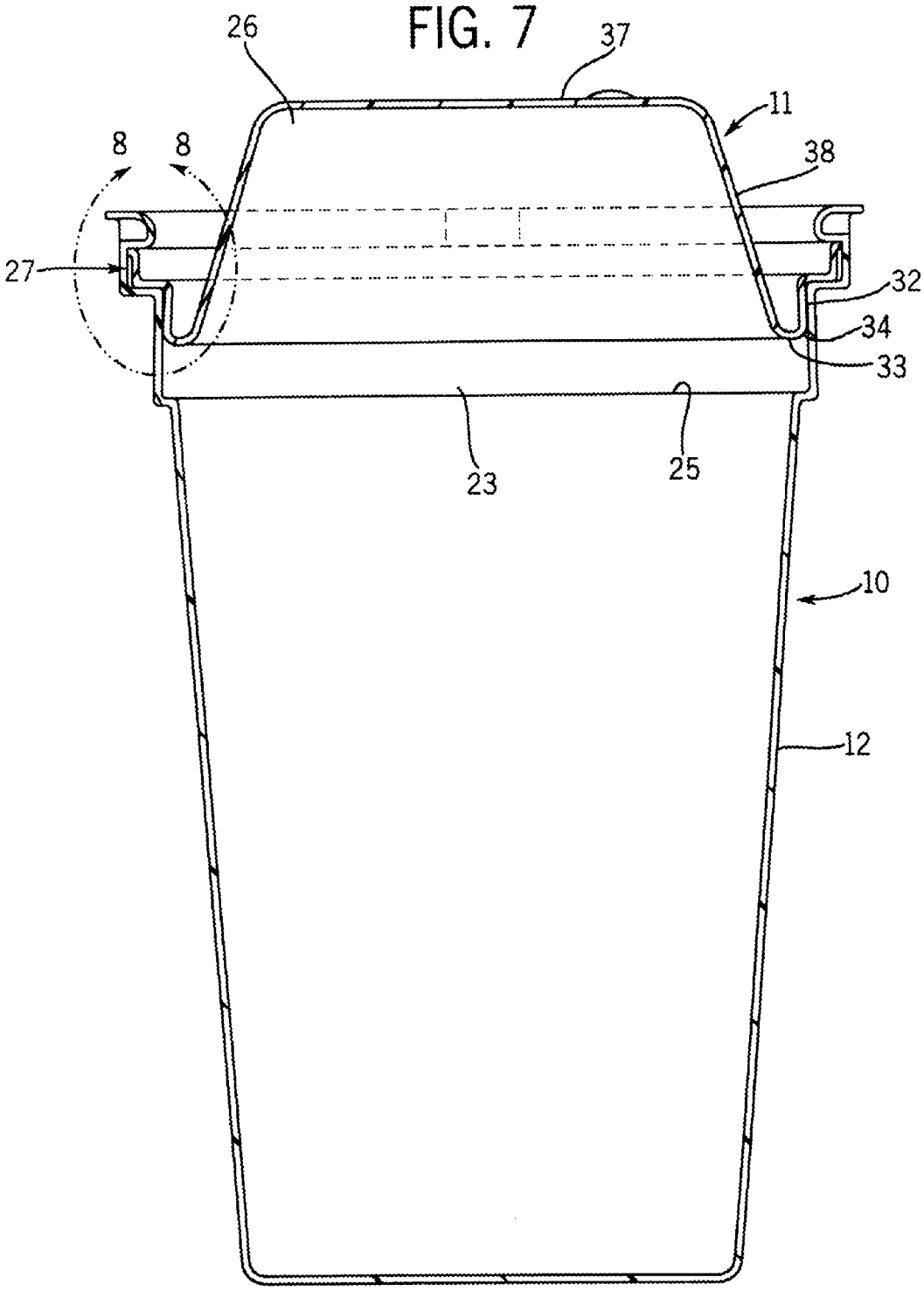
FIG. 7 is a vertical section through the cup and lid assembly taken on line 7—7 of FIG. 5.
Figure 12:
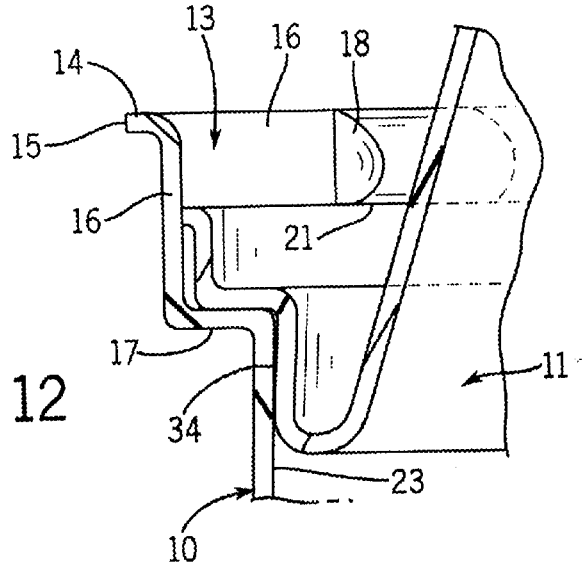
FIG. 12 is a sectional detail taken on line 12—12 of FIG. 5.
Figure 13:
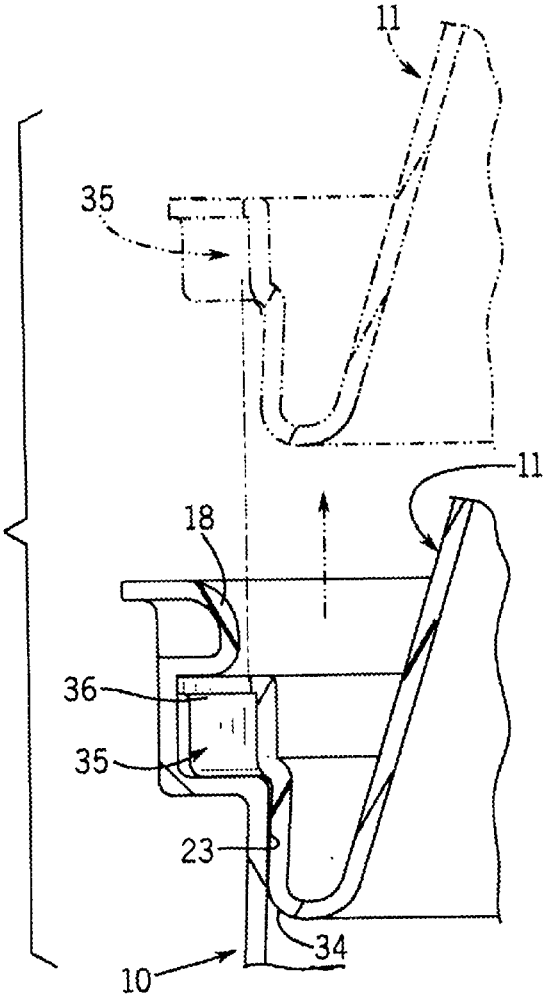
FIG. 13 is an enlarged detail taken on line 13—13 of FIG. 6 showing vertical removal of the lid from its unlocked position in the cup.

However, because it may be desirable to remove the lid from the cup, an unlocking and reopening feature is also provided. The peripheral lip 27 of the lid is provided with recesses 35 that are spaced circumferentially to correspond to the positions of the locking protrusions 18 of the cup. The recesses 35 are defined by continuous recessed portions of the upper lip surface 28 and the intermediate connecting surface 31. Thus, the recesses 35 extend partly into the lower horizontal lip surface 30. When the recesses 35 are rotationally aligned with the locking protrusions 18 as shown in FIGS. 6 and 13, the lid 11 may be grasped and lifted vertically, restrained only by the interference fit between the frustoconical sealing surfaces 23 and 32. However, vertical lifting movement of the lid overcomes the secondary lock as the outer edge bead 34 in the lid is deflected inwardly and passes the inner edge bead 24 in the cup. It should be noted that, while the recesses 35 are aligned with the locking protrusions 18 the lid remains in the closed position, the primary seal between sealing surfaces 23 and 32 remains fully operative and the secondary frictional locking engagement between these surfaces still provides good securement against inadvertent dislodgment of the lid.

In the presently preferred embodiment of the lid 11, the body 26 is raised and has a generally flat top 37 and a downwardly tapering generally frustoconical outer wall 38 which joins at its lower edge to the annular connecting surface 33. The outer wall 38 of the lid is provided with tactile depressions 40 for engagement by the thumb and fingers of the user to permit easy rotational positioning of the recesses 35 in the lid with the locking protrusions 18 for removal of the lid. Obviously, the lid could be provided with other tactile means for facilitating removal, including depressions in the flat top surface 37 or a raised handle also formed in that surface. Similarly, lids having other body shapes could also be utilized.

The lid 11 is readily snapped into full locking and sealing engagement with the cup without the need to first align the recesses 35 in the lid with the locking protrusions 18 in the cup, as is shown in FIG. 2. Thus, no manual rotational prealignment of the parts is necessary and, when installed such that the lip 27 snaps directly under the protrusions and into the locking groove 22, no rotation of the lid in the cup is necessary to assure that it is locked in place. The diameter of the horizontal upper lip surface 28 of the lid is slightly less than the inside diameter of vertical first wall portion 16 of the cup. This assures that the primary seal between frustoconical cup surface 23 and frustoconical lid surface 32 is undisturbed and permits rotation of the lid in the cup without undue frictional binding between the edge of lip surface 28 and the cup wall 16. It will be seen, therefore, that primary sliding contact during rotation of the lid to the unlocking position is between the sealing surfaces 23 and 32.

As mentioned above, sealing wall 32 in the lid has a draft angle that is slightly greater than the draft angle of the sealing wall portion 23 of the cup. This draft angle differential enhances the resilient spring force between the outer edge bead 34 and the cup sealing wall 23 to enhance the seal and to assure that any surface irregularities do not disrupt the seal. Although because of the inherent resilience of the parts, there is likely to be some direct surface-to-surface contact between frustoconical cup wall portion 23 and frustoconical lip sealing wall 32, the primary seal is assured by the greater draft angle of lid wall 32 and primary sealing contact by the outer edge bead 34.

By providing a lid 11 which is wholly contained within the mouth 13 of the cup 10 when installed, there is no free lid lip edge that can be inadvertently engaged or accidentally struck to dislodge the lid, a common problem in conventional cup lids that overlap the outside of the cup rim. The primary lock and sealing features provide excellent security against leakage and dislodgment of the lid if the cup is tipped, bumped or dropped. An inherent benefit of the snap lock of the lip 27 in the locking groove 22 is that it results in an audible "snap". As a result, the person inserting the lid into locking engagement with the cup does not have to look when installing the lid to make sure it is locked in place. The audible snap is a clear indication of locking closure, providing a sense of security to both service personnel and customers.

We claim:

1. A sealed, locked and reopenable cup and lid assembly comprising:

a cup having an open circular mouth defined by an upper edge, an inwardly opening locking groove below the upper edge and a frustoconical inner wall portion extending downwardly and diverging outwardly from the locking groove;

a resilient circular lid sized to be inserted into the open mouth of the cup and having an outer peripheral lip received with a snap fit in said locking groove, and a frustoconical sealing wall extending downwardly and diverging outwardly from the peripheral lip and sealingly engaging said frustoconical wall portion; and, circumferentially spaced and rotationally alignable interrupted portions in said locking groove and said peripheral lip which when aligned permit removal of the lid.

2. The assembly as set forth in claim 1 wherein said locking groove is defined by a plurality of protrusions extending radially inwardly from the upper edge of the cup and an annular horizontal cup wall portion below and spaced from the protrusions.

3. The assembly as set forth in claim 2 wherein the outer peripheral lip of the lid comprises generally horizontal upper and lower lip surfaces interconnected by a generally vertical intermediate lip surface;

said protrusions have generally coplanar lower surfaces; and, said peripheral lip is captured in said locking groove by engagement of said upper and lower surfaces of the lip with the lower surfaces of said protrusions and the horizontal wall portion respectively.

4. The assembly as set forth in claim 3 wherein said interrupted portions in said lid peripheral lip comprise recesses corresponding to the protrusion on the cup upper edge permitting reopening movement of the lid past the protrusions.

5. The assembly as set forth in claim 3 wherein:

the frustoconical inner wall portion of the cup extends downwardly from the radially inner edge of the horizontal wall portion and forms therewith a first edge bead having a first diameter; and, the frustoconical sealing wall extends downwardly from the radially inner edge of the lower lip surface and forms therewith a second edge bead having a second diameter greater than said first diameter.

6. The assembly as set forth in claim 5 wherein said second edge bead is adapted to override said first edge bead by lateral deflection in response to lid insertion and to resiliently return to provide the sealing engagement between said frustoconical sealing wall and said frustoconical wall portion.

7. The assembly as set forth in claim 6 wherein the angle of divergence of said frustoconical wall portion is less than the angle of divergence of said frustoconical sealing wall.

8. A sealing and locking cup and lid assembly comprising:

a cup having an open circular mouth defined by a cylindrical generally vertical inner first wall portion, an annular generally horizontal second wall portion extending radially inwardly from the lower edge of said first wall portion, a plurality of locking protrusions spaced circumferentially around and extending radially inwardly from said first wall portion, said protrusions having generally coplanar lower surfaces spaced vertically above said annular generally horizontal second wall portion, and a frustoconical inner third wall portion extending downwardly and diverging outwardly from the inner edge of said second wall portion;

a resilient circular lid sized to fit within the open mouth of the cup and having an outer peripheral lip arrangement, a frustoconical sealing wall extending downwardly and diverging outwardly from a radially inner edge of said lip arrangement;

whereby in response to vertical downward insertion of the lid into the mouth of the cup, the lip arrangement is inwardly deflected by contact with said locking protrusions and is locked between the lower surfaces thereof and the horizontal second wall portion of the cup, and said sealing wall engages and seals against said third wall portion of the cup.

9. The assembly as set forth in claim 8 wherein said lip arrangement comprises generally horizontal upper and lower lip surfaces joined by a frustoconical downwardly convergent connecting surface.

10. The assembly as set forth in claim 9 wherein said locking protrusions have upper lead-in surfaces that extend radially inwardly and downwardly from the upper edge of said first wall portion.

11. The assembly as set forth in claim 8 comprising recesses formed in said lip arrangement and positioned circumferentially to correspond to said locking protrusions, said recesses providing clearance for said protrusions when aligned therewith to permit the lid to be removed from the cup.

12. The assembly as set forth in claim 11 wherein said recesses are defined by continuous recessed portions of the upper lip and connecting surface of said lip arrangement.

13. The assembly as set forth in claim 8 wherein said lid further comprises a raised center body joined along an outer peripheral edge to the lower edge of the sealing wall.

14. The assembly as set forth in claim 13 including an annular connecting surface joining the center body of the lid to the sealing wall.

15. The assembly as set forth in claim 13 wherein said lid body includes a generally frustoconical outer wall surrounding a generally flat center surface.

16. The assembly as set forth in claim 15 wherein said outer wall includes tactile depressions adapted to be engaged by the fingers of a user to facilitate relative rotation of the lid with respect to the cup.

* * * * *